US010582774B2

(12) United States Patent
White

(10) Patent No.: US 10,582,774 B2
(45) **Date of Patent: *Mar. 10, 2020**

(54) RETRACTABLE STEP STOOL/ACCESS DEVICE

(71) Applicant: Ralph Layne White, North Little Rock, AR (US)

(72) Inventor: Ralph Layne White, North Little Rock, AR (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/334,083

(22) Filed: Oct. 25, 2016

(65) Prior Publication Data

US 2017/0035206 A1 Feb. 9, 2017

Related U.S. Application Data

(63) Continuation of application No. 13/707,900, filed on Dec. 7, 2012, now Pat. No. 9,480,342.

(51) Int. Cl.

| | |
|---|---|
| ***A47C 12/00*** | (2006.01) |
| ***E06C 9/06*** | (2006.01) |
| ***E06C 1/00*** | (2006.01) |
| ***A47K 17/02*** | (2006.01) |
| *A47B 97/00* | (2006.01) |

(52) U.S. Cl.

CPC ..... *A47C 12/00* (2013.01); *A47K 17/028* (2013.01); *E06C 1/005* (2013.01); *E06C 9/06* (2013.01); *A47B 97/00* (2013.01); *A47B 2220/05* (2013.01)

(58) Field of Classification Search

CPC ..... A47C 11/02; A47C 16/025; A47C 16/04; A47C 12/00; A47C 12/02; A47C 10/00;

(Continued)

(56) References Cited

U.S. PATENT DOCUMENTS 538,489 A * 4/1895 Hoffmeyer ..... A47C 16/04 182/88

590,268 A * 9/1897 Lee ..... A61G 5/12 296/75

(Continued)

*Primary Examiner* — Daniel P Cahn

(57) ABSTRACT

A retractable step stool assembly for assisting a person in elevating him or herself above a floor includes a base member, a step stool member which in an upright position has a generally horizontal platform surface and two side members which depend downwardly from opposite ends of the platform surface, and an arm assembly which is configured to pivotally connect the step stool member to the base member for movement of the step stool member between a stored position in which the step stool member is positioned over the base member to a deployed position in which the step stool member is positioned on the floor in front of the base member. The arm assembly is configured such that the platform surface remains generally horizontal during movement of the step stool member between the stored position and the deployed position. The step stool member includes an upwardly directed foot-engaging member which is engageable by the bottom of the person's foot and is configured to transfer at least an initial downwardly directed force from the person's foot into movement of the step stool member from the stored position toward the deployed position. In this manner, the person can move the step stool member from the stored position to the deployed position by engaging the foot-engaging member with only his or her foot.

20 Claims, 5 Drawing Sheets

(58) Field of Classification Search
CPC ..... A47C 9/06; A47B 2200/041; A47B 3/14; A47B 97/00; A47B 2220/05; A47B 77/10; A47B 46/00; A47B 46/005; A47B 5/06; E06C 1/005; E06C 9/06; E04G 3/00; B65F 2210/178
USPC .... 182/33, 35, 33.6, 91, 19; 248/240, 240.1, 248/240.2; 4/621; 312/235.1; 108/137, 108/159
See application file for complete search history.

(56) References Cited

U.S. PATENT DOCUMENTS 663,632 A * 12/1900 Mack ..... A47C 16/025 297/423.46
701,050 A * 5/1902 Keeran ..... A47C 16/04 182/91
956,024 A * 4/1910 Ballam ..... A47C 9/022 297/141
1,402,698 A * 1/1922 Weingarten ..... A47C 7/52 297/423.2
1,587,002 A * 6/1926 Jones ..... E06C 1/005 182/33.5
1,652,100 A * 12/1927 Eastburn ..... A47B 83/02 297/141
1,657,307 A * 1/1928 Hisey ..... A47B 83/02 297/141
1,681,879 A * 8/1928 Putnam ..... A47C 12/02 182/33.5
1,758,726 A * 5/1930 Webb ..... A47B 5/06 108/99
2,170,098 A * 8/1939 Stephenson ..... A47B 21/02 108/136
2,326,910 A * 8/1943 Young ..... A47C 1/032 297/423.21
2,551,661 A * 5/1951 Feinson ..... A47C 11/02 297/423.1
2,599,529 A * 6/1952 Harvey ..... A47C 9/06 108/134
2,682,297 A * 6/1954 Hamilton ..... A47C 12/02 108/158
2,845,114 A * 7/1958 Edwards ..... A47B 83/02 108/138
2,858,056 A * 10/1958 Ownby ..... A47C 9/06 108/134
2,881,040 A * 4/1959 Hartridge ..... A47B 77/10 182/33.6
2,899,010 A * 8/1959 Ledgerwood ..... B62B 5/049 182/106
2,900,011 A * 8/1959 Casey ..... A47C 12/02 182/33.5
3,020,972 A * 2/1962 Hockett ..... B62B 3/00 182/120
3,102,757 A * 9/1963 Higgins ..... A47C 11/02 297/187
3,287,065 A * 11/1966 Barecki ..... A47C 16/04 297/423.16
3,288,090 A * 11/1966 King ..... D06F 81/04 108/138
3,397,757 A * 8/1968 Greer ..... A47B 77/10 182/129
3,398,988 A * 8/1968 Noe ..... A47C 11/02 297/187
3,556,248 A * 1/1971 Brown ..... B62B 3/00 182/15
4,135,604 A * 1/1979 Ryan ..... E06C 9/06 182/129
4,174,021 A * 11/1979 Barlock ..... B62B 5/00 182/127
4,194,452 A * 3/1980 Crowther ..... A47B 9/00 108/138
4,652,003 A * 3/1987 Karashima ..... B62B 5/00 182/127
4,736,998 A * 4/1988 Wilson ..... A47B 83/02 297/140
4,860,393 A * 8/1989 Schefthaler ..... A47C 17/134 5/14
5,009,282 A * 4/1991 Willsher ..... E06C 1/005 182/129
5,048,639 A * 9/1991 Scherer ..... A45C 11/20 114/362
5,131,492 A * 7/1992 Caminiti ..... A47B 46/005 182/156
5,341,897 A * 8/1994 Gross ..... A47B 77/10 182/35
5,444,928 A * 8/1995 Sagel ..... A47B 77/10 38/104
5,544,592 A * 8/1996 Leezer ..... A47B 5/06 108/123
5,819,670 A * 10/1998 O'Connor ..... A47B 5/06 108/134
5,941,341 A * 8/1999 Gillis ..... E06C 1/397 182/15
5,967,255 A * 10/1999 Young ..... A47B 5/06 182/91
5,974,980 A * 11/1999 Kent ..... A47B 77/10 108/42
6,234,553 B1 * 5/2001 Eschelbach ..... B60N 2/015 296/65.05
6,378,720 B1 * 4/2002 Santa Cruz ..... B65F 1/062 182/91
6,840,583 B1 * 1/2005 Turner ..... A47C 12/02 297/175
7,083,235 B2 * 8/2006 Grimm ..... A47C 1/03211 297/423.21
7,547,072 B1 * 6/2009 Delmestri ..... A47C 7/506 297/423.21
7,654,208 B2 * 2/2010 Patten ..... A47B 46/005 108/138
7,828,115 B2 * 11/2010 Sayles ..... E06C 1/397 182/15
7,841,447 B2 * 11/2010 Frame ..... E06C 1/387 182/15
7,966,947 B2 * 6/2011 Roleder ..... A47C 20/041 108/3
9,049,923 B1 * 6/2015 Delagey ..... A47B 9/18
9,290,991 B1 * 3/2016 McDill ..... E06C 1/005
9,828,014 B1 * 11/2017 Gillespie ..... B62B 5/00
2003/0154890 A1 * 8/2003 Warner ..... A47B 9/00 108/145
2003/0209385 A1 * 11/2003 Kuehl ..... E06C 1/39 182/17
2004/0089206 A1 * 5/2004 Myers ..... A47B 5/06 108/42
2007/0046078 A1 * 3/2007 Humfeldt ..... A47B 83/00 297/142
2007/0089648 A1 * 4/2007 Harrison ..... A47B 9/16 108/115
2008/0264723 A1 * 10/2008 Tatum ..... A47C 12/00 182/35
2011/0109126 A1 * 5/2011 Breit ..... A47C 4/20 297/16.1
2011/0214942 A1 * 9/2011 Niemiec ..... E04G 3/00 182/19
2012/0086317 A1 * 4/2012 Baran ..... A47B 77/10 312/237
2013/0213738 A1 * 8/2013 Schroeder ..... E06C 9/06 182/90
2015/0001005 A1 * 1/2015 Goodson ..... E06C 1/005 182/96
2015/0033786 A1 * 2/2015 Mansfield ..... F25D 23/12 62/449

* cited by examiner

RETRACTABLE STEP STOOL/ACCESS DEVICE

This application is a continuation of U.S. patent application Ser. No. 13/707,900 filed on Dec. 7, 2012.

BACKGROUND OF THE INVENTION

1. Field of the Invention

This invention was conceived as an improvement over prior art apparatus and methods for stowable, deployable, step stools which the user can selectively position in a raised or retracted/stored position or in a lowered or extended step accessible position. Relevant prior art to this invention is found in U.S. Patent Class 182, subclass 91.

2. Description of the Related Art

Presently there are step stools of various configurations in the public domain as well as patented step stool type devices for allowing access to items, articles, and devices that are beyond vertical reach of certain persons such as children and adults of small stature and/or lesser height than the average adult. One common form of step stool is a one piece box like structure or a platform with short legs for giving a person a one step height advantage over just standing on the floor. Use is accomplished by locating the step stool in its stored location and moving and positioning it on the floor below the area to be accessed. The user then steps on the step stool thereby gaining the extra vertical reach required to retrieve an item or access a device. The user, when finished, steps off the step stool and normally moves it back to its original stored position. Such step stools are not limited to a box like structure of square or rectangular shape but can be round or oval or of odd shapes as long as a horizontal step area is provided and legs or side structure is provided that yields a stable platform on which to stand thereby gaining an extra height/reach advantage. The use and deployment of such a simple step stool normally requires the user to physically bend down and grasp the step stool with one's hands, lift it and position it in the desired location of use. Then after use again grasp the step stool, lifting it and returning it to its place of storage. A favored use of a step stool for a child is for gaining a height advantage at the bathroom lavatory for washing and grooming. This is so in the place of residence but also at public facilities. Both present a sanitation issue since after the person has washed up and stepped off the step stool and then grasps the step stool and returns it to its stored location they have again soiled their hands, but now cannot reach the sink to wash them again. This situation needs a remedy. A convenient place for storing the step stool is under the sink or in or about the sink/lavatory cabinetry. The prior art has attempted to address this situation by various means. Such means have taken the forms of steps that's hinged to a structure so that the step can be folded out into position and after use be repositioned to the stored position by folding the step back. Others seek to accomplish this by deployment and restoring by use of a sliding mechanism.

Both U.S. Pat. No. 8,037,557 to Sumpton et al (2011) and U.S. Pat. No. 5,131,492 to Caminiti (1992) show repositional steps manually actuated by the user. Both of these patents show the ability to be disposed in a stored configuration or access configuration. U.S. Pat. No. 8,037,557 to Sumpton (2011) provides a sink access device which has a top step platform pivotally attached to a base. The base is secured to the floor with the step platform able to be positioned in a vertical, stored position or a horizontal step accessible position. The Sumpton patent device is mechanically fastened to the floor beneath a sink or lavatory to provide a step platform for a child or other diminutive person to reach the sink. The Sumpton patent device is meant to be used in conjunction with a sink exclusively. The Sumpton device cannot be installed inside of any enclosure such as cabinetry and the base is mounted at floor level only. The base cannot be relocated to facilitate the cleaning of the floor and no component for storage of loose items is provided.

U.S. Pat. No. 5,131,492 to Caminiti provides a collapsible folding step-stool which is mountable to a cabinet door. The step stool has a bracket mountable to a cabinet door and a step platform. The platform may be lowered from a raised vertical stored orientation to a horizontal operative position in which the platform is supported by four legs which contact and rest upon the floor. A plurality of parallel arms pivotally couple the step platform to a U-shaped member which is in turn mounted to the cabinet door. The step platform is manually raised from a horizontal operative position to a vertical stored orientation disposed within the U-shaped channel. The pivotally coupled four legs collapse and fold to a position within the U-shaped channel secured to the cabinet door. In the Caminiti patent the platform must be repositioned manually thereby requiring the use of the hands. The device cannot be stored within an enclosure like a bathroom or kitchen cabinet and provides no storage tray for loose items. Further, the user must bend down and manually lock the step platform in the vertical stored orientation within the U-shaped channel.

In conclusion, I am aware of no easily deployable step access assembly which can be readily lowered from a stored, raised position to a lowered step accessible position without using the hands. Ideally a step access assembly for a child or small person should remain in a position horizontal to the floor while being positioned for step access. This would remove the need to position the platform manually from a vertical stored orientation to a horizontal lowered position to provide the needed gain in vertical reach required by the user without contaminating their hands. Furthermore, I am aware of no such deployable step access assembly which provides a storage tray for loose items while also facilitating ease of floor maintenance and cleaning.

BRIEF SUMMARY OF THE PRESENT INVENTION

The invention, an improved retractable step stool/access device, is made from rigid materials. The device can be lowered from a retracted, stored position to a lowered, deployed step accessible position by the user's foot. The retractable step stool's upper step platform remains positioned horizontal to the floor throughout the deployment/retraction cycle. Internal stored energy mechanisms provide assistance to a user, especially small children, for ease of vertically repositioning the device to the retracted position podiatrically. Accordingly, a fundamental object of the invention is to provide a retractable step stool to be utilized by a diminutive person to gain desired vertical reach. Another basic object is to provide a quickly deployable and retractable step stool to be utilized in several applications where extra vertical reach height is required. It is also an object to allow operation of the retractable step stool/access device by not requiring the user to manually engage the device. Further, an important object is to require operation of the device to be accomplished by use of the users feet only. Another object is to provide a storage tray for the containment of loose items while also facilitating ease of cleaning and maintenance of floored surfaces. Still further objects and advantages will become apparent from a study of the following description and the accompanying drawings.

BRIEF DESCRIPTION OF THE DRAWINGS

In the following drawings, which form a part of the specification and which are to be construed in conjunction therewith, and in which like reference numerals have been employed throughout wherever possible to indicate like parts in various views.

DESCRIPTION OF THE INVENTION

Figure 1:
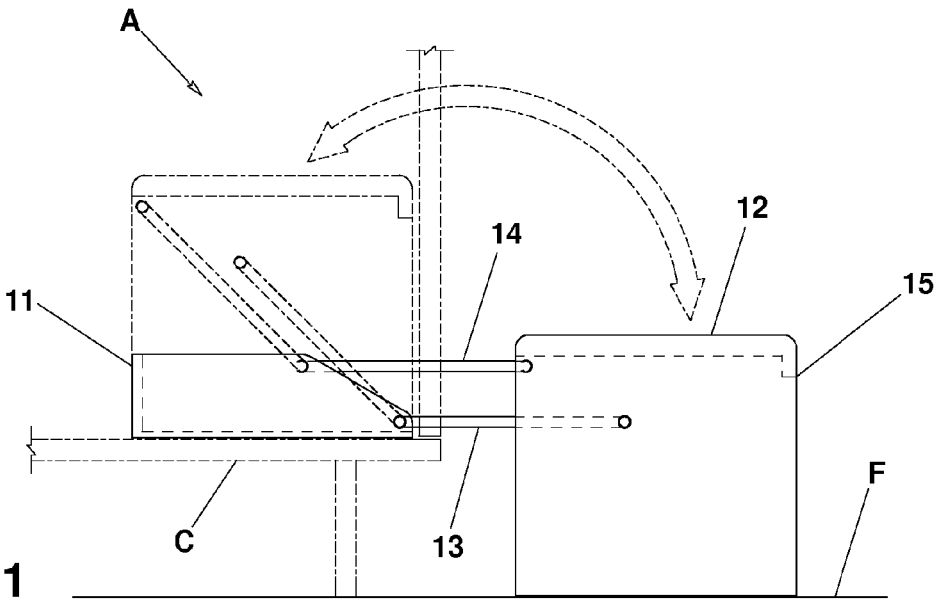
FIG. 1 is a right side elevation view of version 1 mounted in a cabinet showing the retractable step stool/access device in a lowered deployed position.
Figure 2:
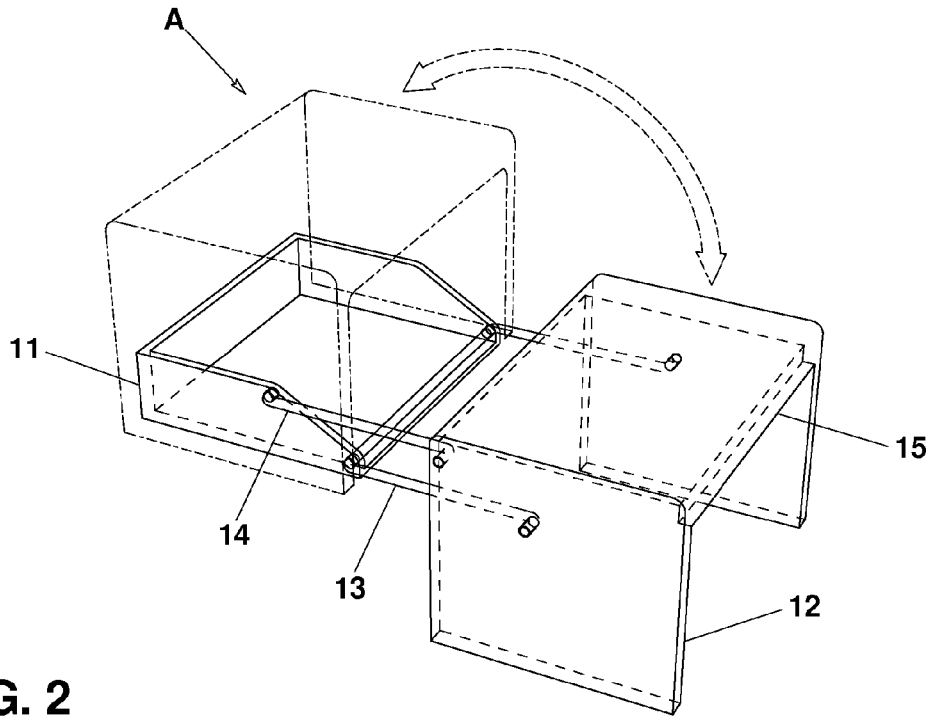
FIG. 2 is a perspective view of version 1 mounted in a cabinet showing the retractable step stool/access device in a lowered deployed position.
Figure 9:
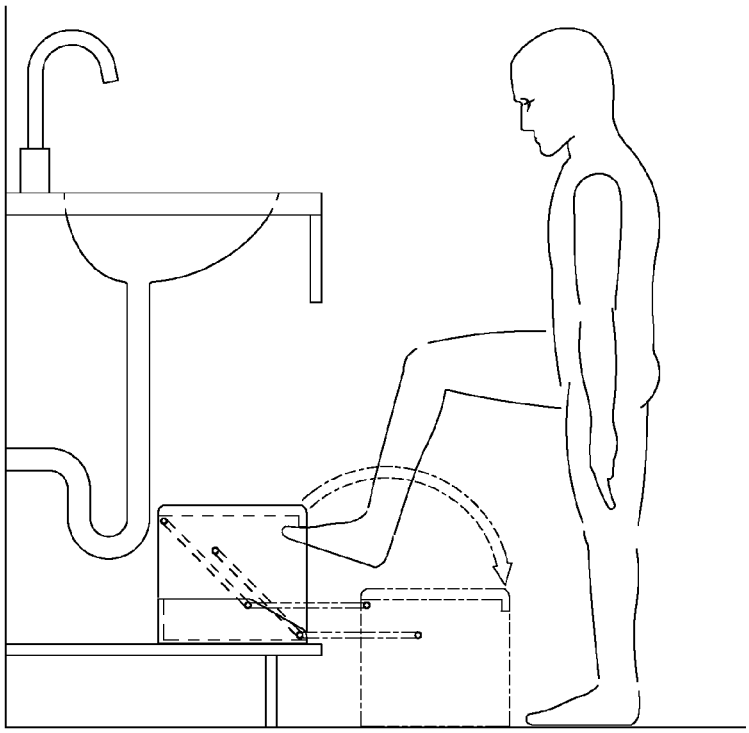
FIG. 9 is a side elevation view showing a small person deploying/restoring version 1-2 of the step stool/access device.

With reference to the drawings:

FIGS. 1 and 2 illustrate version 1 mounted within a cabinet C resting upon a floor F. The retractable step stool/access device assembly A, includes base storage tray 11 and step stool 12. Base storage tray 11 and step stool 12 are constructed of rigid material and are generally rectangular in shape. Step stool 12 has a top step platform with a down turning forward lip 15, and an open front and rear with two opposed supporting sides. Base storage tray 11 and step stool 12 are connected by means of formed rod members, lower arm 13, essentially in a U-shape, and upper arm 14, both preferably made of steel. Lower arm 13 is pivotally connected to the forward edge of base 11 with the ends of the right and left upper portions of the U-shaped arm 13 turning outward and inserting into two holes located on the interior surfaces of the opposed sides of step stool 12. The singular upper arm 14 is pivotally connected to one side of the base storage tray 11 and extends to a pivotal connection point within the interior of step stool 12. As depicted in FIG. 9, a child can, by placing the toe of the foot under lip 15 lift step stool 12 from the stored position over base storage tray 11, move step stool 12 through an arc that is guided by lower arm 13 and upper arm 14 and bring step stool 12 to rest on floor F. After using step stool 12 to gain the necessary height/reach advantage, step stool 12 is returned to the stowed position over base storage tray 11 by again using the foot.

Figure 3:
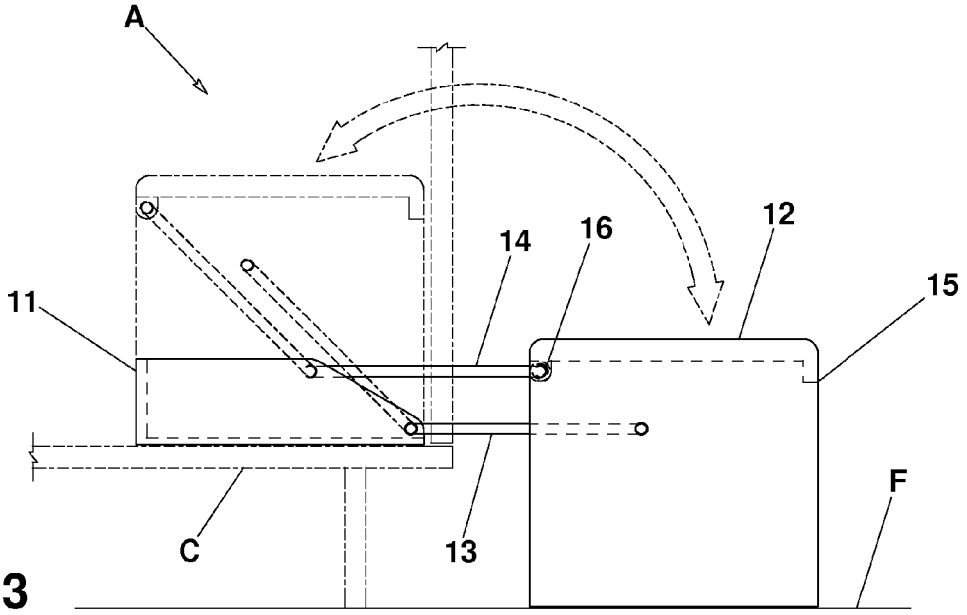
FIG. 3 is a right side elevation view of version 2 mounted in a cabinet showing the retractable step stool/access device in a lowered deployed position.
Figure 4:
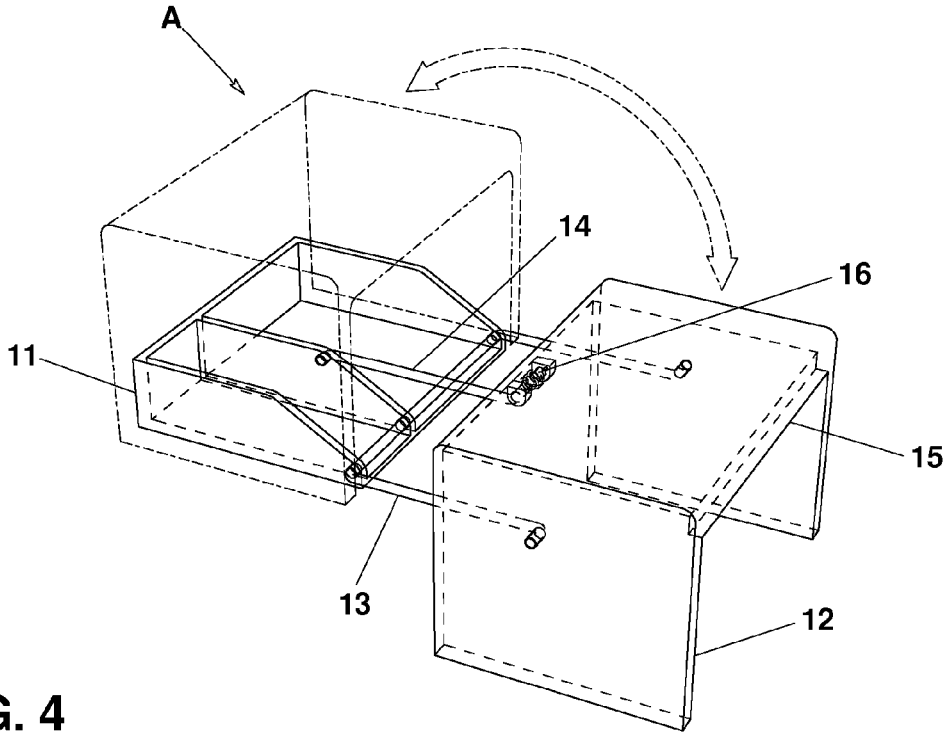
FIG. 4 is a perspective view of version 2 mounted in a cabinet showing the retractable step stool/access device in a lowered deployed position.

FIGS. 3 and 4 illustrate a second version of the invention. In this version positioning of the step stool 12 between the stored position and the deployed position is assisted by mechanical energy stored in torsion spring 16. Torsion spring 16 is attached underneath the top step surface of step stool 12, at the rearward edge, while also being pivotally connected to the upper arm 14 at one end with the other end of arm 14 being pivotally connected to a centrally located divider wall in the interior of the base storage tray 11. Deployment and retraction of step stool 12 is done with the foot in the same fashion as before but with less effort due to the assist from the energy stored in the torsion spring 16.

Figure 5:
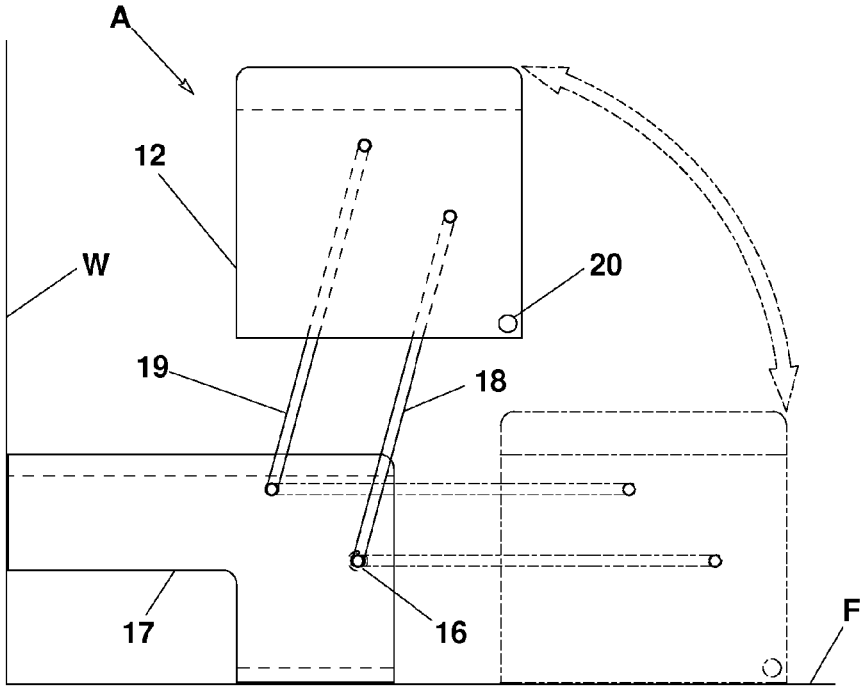
FIG. 5 is a right side elevation view of version 3 mounted to a wall showing the retractable step stool/access device in a raised stored position.
Figure 6:
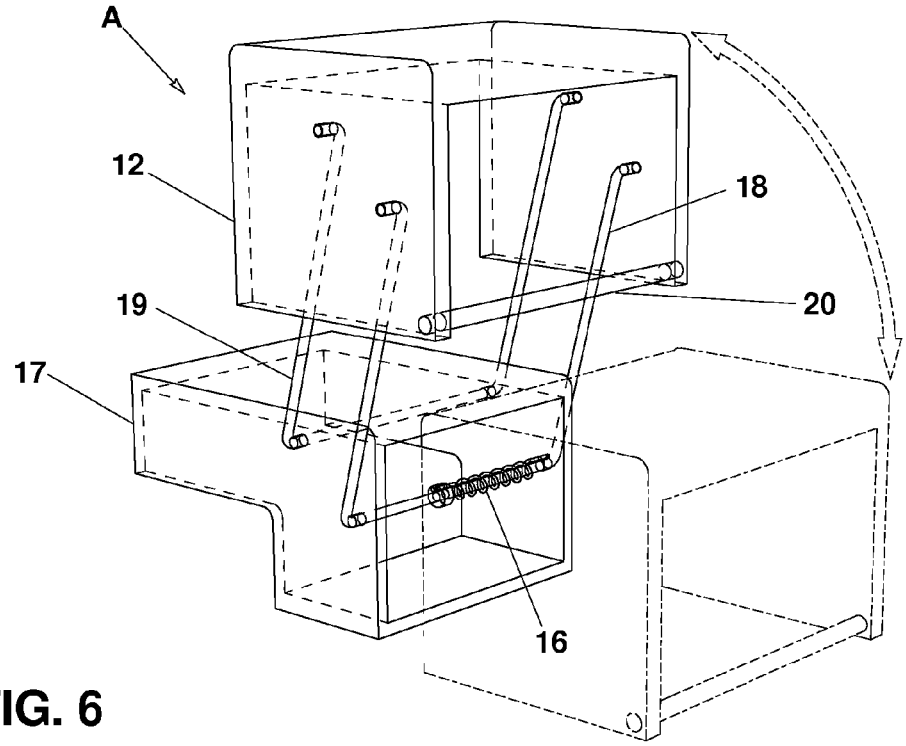
FIG. 6 is a perspective view of version 3 mounted to a wall showing the retractable step stool/access device in a raised stored position.

FIGS. 5 and 6 show a third variation of the invention. This variant of the retractable step stool/access device assembly A is generally comprised of a step stool 12 and a hybrid base 17. The hybrid base 17 can be mounted to a floor F or mounted to an upright structural wall W. Step stool 12 is pivotally coupled to hybrid base 17 by an extended U-shaped lower arm 18 and an extended U-shaped upper arm 19. The lower sections of extended arms 18 and 19 are contained within and pass through holes located in the right and left opposed sides of hybrid base 17. The upper ends of extended arms 18 and 19 turn outboard and insert into holes located in the inside surfaces of the supporting sides of step stool 12. Step stool 12 is lowered to floor F by placing a foot upon and pressing downward on foot bar 20, which is connected to step stool 12 at the lower forward corners. Torsion spring 16 is connected to the lower portion of lower extended arm 18 to provide stored mechanical energy to lift step stool 12 to the retracted position.

Figure 10:
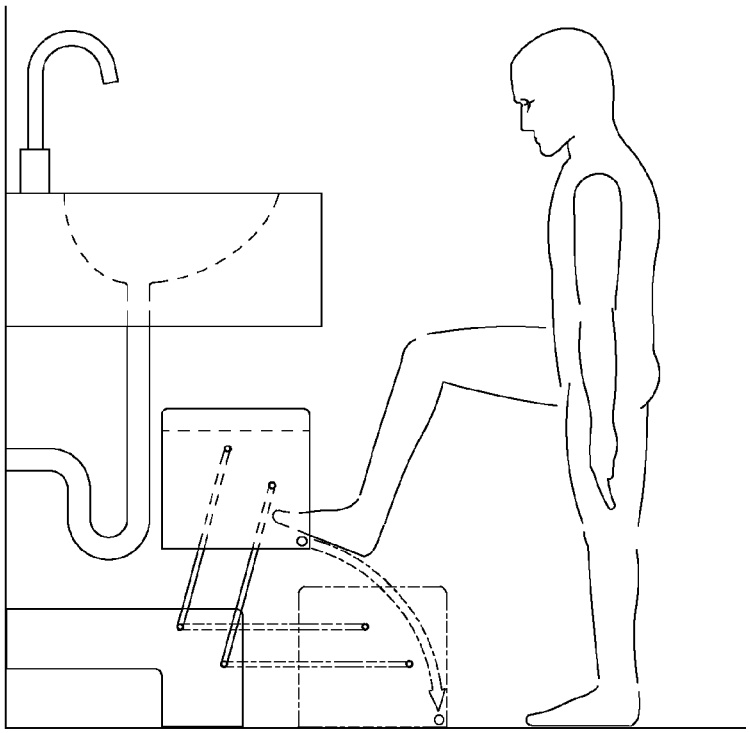
FIG. 10 is a side elevation view showing a small person deploying/restoring version 3-4 of the step stool/access device.

As depicted in FIG. 10, a child can place a foot over bar 20 and press downward to move the stepstool to the floor F. The stepstool 12 retracts to the stowed position due to the energy stored in the torsion spring 16.

Figure 7:
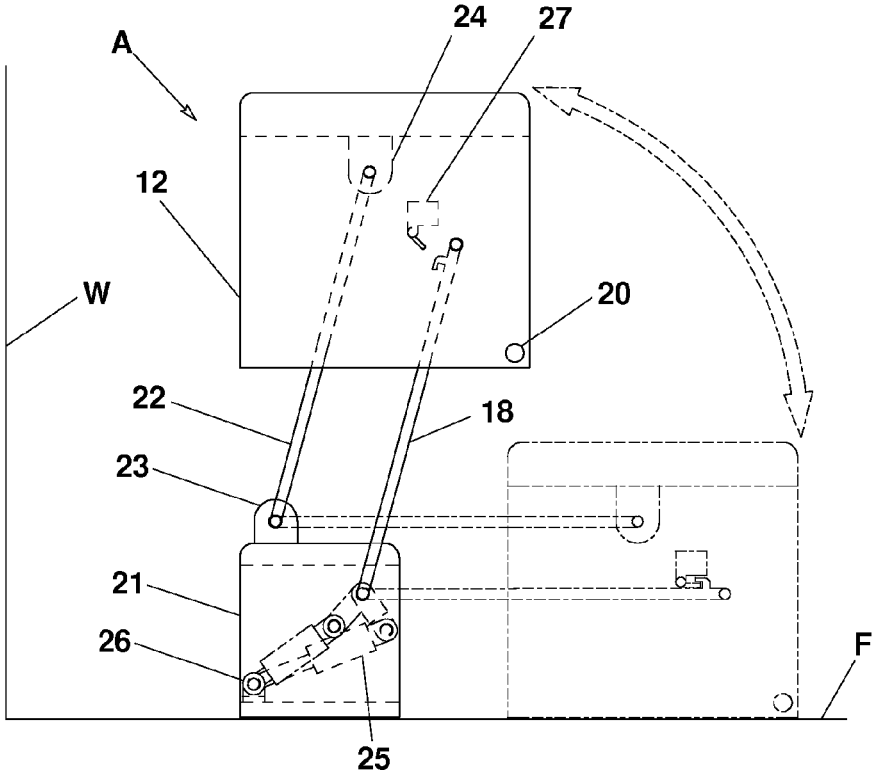
FIG. 7 is a right side elevation view of version 4 mounted to the floor showing the retractable step stool/access device in a raised stored position.
Figure 8:
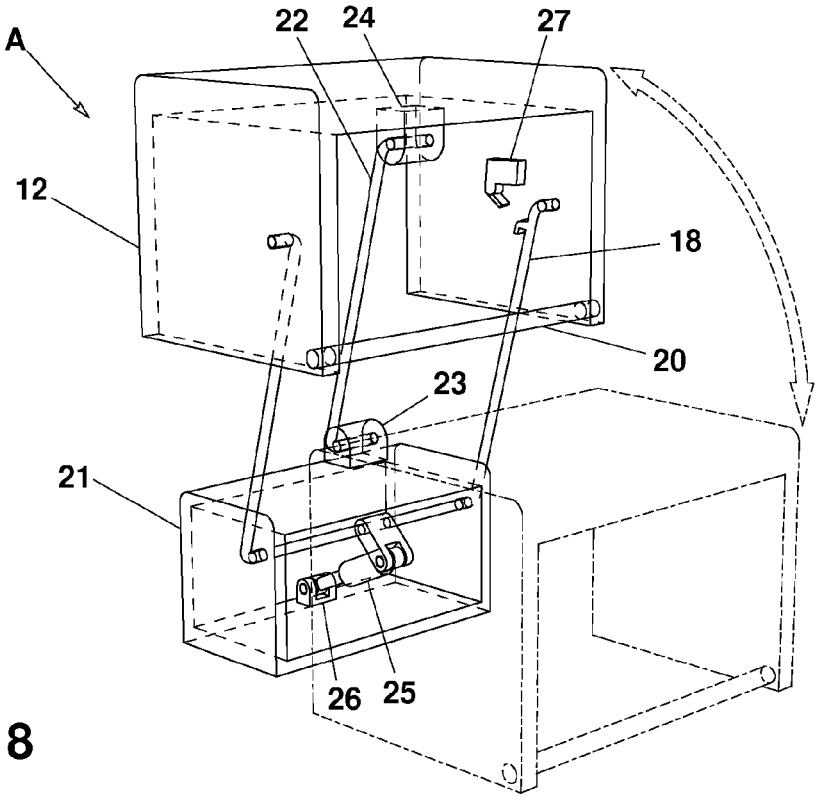
FIG. 8 is a perspective view of version 4 mounted to the floor showing the retractable step stool/access device in a raised stored position.

FIGS. 7 and 8 illustrate a fourth version of the invention. In this version the retractable step stool/access device assembly A is comprised generally of a step stool 12 and a floor mount base 21. The floor mount base 21 is mounted to the floor F. Step stool 12 is pivotally attached to floor base 21 by lower extended arm 18 and upper singular extended arm 22. Lower extended arm 18 is generally U-shaped with the lower segment captured within and passing through holes located in the upper forward corners of the opposing right and left sides of the floor base 21. The upper ends of the extended arm 18 bend outward and are captured within holes located on the insides of the opposed right and left supporting sides of the step stool 12. The upper singular extended arm 22 is pivotally attached at one end to a lower bracket 23 which is attached to the floor base 21 at the rearward upper edge. The opposing end of the upper singular extended arm 22 is pivotally attached to an upper bracket 24 which is attached to the underside of the top step platform of step stool 12. A gas spring 25 is pivotally attached to the lower portion of the lower extended arm 18 and to a central bracket 26 which is connected at the lower inside surface to floor base 21. Mechanical energy stored within gas spring 25 is utilized to lift the step stool 12 to a retracted or stowed position. Additionally, a latch mechanism 27 may be utilized in conjunction with the gas spring 25 that would engage when the step stool 12 is pressed to the floor allowing a child to step up onto the step stool 12 without having to continue to press it to the floor. Upon stepping up onto the step stool 12, the latch 27 would disengage so that when the child stepped off of the step stool 12, the mechanical energy of the gas spring would retract the step stool 12 to a stowed position.

What is claimed is:

1. A retractable step stool assembly for assisting a person in elevating him or herself above a floor, the step stool assembly comprising:

a base member;

a step stool member which comprises a generally horizontal platform surface and two side members which depend downwardly from opposite ends of the platform surface; and an arm assembly which is configured to pivotally connect the step stool member to the base member for movement of the step stool member between a stored position in which the step stool member is positioned over the base member and a deployed position in which the step stool member is positioned on the floor in front of the base member, the arm assembly being configured such that the platform surface remains generally horizontal during movement of the step stool member between the stored position and the deployed position;

wherein the step stool member comprises a vertically upwardly directed foot-engaging member which is spaced apart from and located vertically below the platform surface, and wherein the arm assembly and the foot-engaging member are together configured to transfer at least an initial vertically downwardly directed force from a person's foot into movement of the step stool member from the stored position toward the deployed position;

whereby the person can move the step stool member from the stored position to the deployed position by engaging the foot-engaging member with only the foot;

wherein the arm assembly comprises at least a first arm member which is pivotally connected to the base member at a first location and to the step stool member at a second location, and wherein when the step stool member is in the stored position, a line extending between the first and second locations is oriented at an angle of less than 90° relative to horizontal as measured from a location in front of the base member;

wherein the arm assembly comprises at least a second arm member which is pivotally connected between the base member and the step stool member and, when the step stool assembly is viewed in profile with the step stool member in the deployed position, the first arm member is spaced above and oriented generally parallel to the second arm member; and wherein the first arm member comprises a generally U-shaped configuration having a middle portion which is pivotally connected directly to the base member and two end portions which are pivotally connected to opposite sides of the step stool member.

2. The step stool assembly of claim 1, wherein the second arm member comprises a generally U-shaped configuration having a middle portion which is pivotally connected to the base member and two end portions which are pivotally connected to the opposite sides of the step stool member.

3. The step stool assembly of claim 1, wherein the second arm member comprises a first end which is pivotally connected to the base member and a second end which is pivotally connected to the step stool member.

4. A retractable step stool assembly for assisting a person in elevating him or herself above a floor, the step stool assembly comprising:

a base member;

a step stool member which comprises a generally horizontal platform surface and two side members which depend downwardly from opposite ends of the platform surface; and an arm assembly which is configured to pivotally connect the step stool member to the base member for movement of the step stool member between a stored position in which the step stool member is positioned over the base member and a deployed position in which the step stool member is positioned on the floor in front of the base member, the arm assembly being configured such that the platform surface remains generally horizontal during movement of the step stool member between the stored position and the deployed position;

wherein the step stool member comprises a vertically upwardly directed foot-engaging member which is spaced apart from and located vertically below the platform surface, and wherein the arm assembly and the foot-engaging member are together configured to transfer at least an initial vertically downwardly directed force from a person's foot into movement of the step stool member from the stored position toward the deployed position;

whereby the person can move the step stool member from the stored position to the deployed position by engaging the foot-engaging member with only the foot;

wherein the arm assembly comprises at least a first arm member which is pivotally connected to the base member at a first location and to the step stool member at a second location, and wherein when the step stool member is in the stored position, a line extending between the first and second locations is oriented at an angle of less than 90° relative to horizontal as measured from a location in front of the base member;

wherein the step stool assembly further comprises means for generating a force on the step stool member which acts in the direction of movement of the step stool member from the deployed position to the stored position, said force generating means being connected between the first arm member and one of the base member and the step stool member; and wherein the first arm member comprises a generally U-shaped configuration having a middle portion which is pivotally connected directly to the base member and two end portions which are pivotally connected to opposite sides of the step stool member, and wherein the means for generating a force on the step stool member comprises a torsion spring which is connected between the base member and the middle portion of the first arm member.

5. A retractable step stool assembly for assisting a person in elevating him or herself above a floor, the step stool assembly comprising:

a base member;

a step stool member which comprises a generally horizontal platform surface and two side members which depend downwardly from opposite ends of the platform surface; and an arm assembly which is configured to pivotally connect the step stool member to the base member for movement of the step stool member between a stored position in which the step stool member is positioned over the base member and a deployed position in which the step stool member is positioned on the floor in front of the base member, the arm assembly being configured such that the platform surface remains generally horizontal during movement of the step stool member between the stored position and the deployed position;

wherein the step stool member comprises a vertically upwardly directed foot-engaging member which is spaced apart from and located vertically below the platform surface, and wherein the arm assembly and the foot-engaging member are together configured to transfer at least an initial vertically downwardly directed force from a person's foot into movement of the step stool member from the stored position toward the deployed position;

whereby the person can move the step stool member from the stored position to the deployed position by engaging the foot-engaging member with only the foot;

wherein the arm assembly comprises at least a first arm member which is pivotally connected to the base member at a first location and to the step stool member at a second location, and wherein when the step stool member is in the stored position, a line extending between the first and second locations is oriented at an angle of less than 90° relative to horizontal as measured from a location in front of the base member;

wherein the step stool assembly further comprises means for generating a force on the step stool member which acts in the direction of movement of the step stool member from the deployed position to the stored position, said force generating means being connected between the first arm member and one of the base member and the step stool member;

wherein the means for generating a force on the step stool member comprises a gas spring; and wherein the first arm member comprises a generally U-shaped configuration having a middle portion which is pivotally connected directly to the base member and two end portions which are pivotally connected to opposite sides of the step stool member, and wherein the gas spring comprises a first end which is pivotally connected to the base member and a second end which is pivotally connected to a linkage that in turn is fixedly connected to the middle portion of the first arm member.

6. A retractable step stool assembly for assisting a person in elevating him or herself above a floor, the step stool assembly comprising:

a base member;

a step stool member which comprises a generally horizontal platform surface and two side members which depend downwardly from opposite ends of the platform surface; and an arm assembly which is configured to pivotally connect the step stool member to the base member for movement of the step stool member between a stored position in which the step stool member is positioned over the base member and a deployed position in which the step stool member is positioned on the floor in front of the base member, the arm assembly being configured such that the platform surface remains generally horizontal during movement of the step stool member between the stored position and the deployed position;

wherein the step stool member comprises a vertically upwardly directed foot-engaging member which is spaced apart from and located vertically below the platform surface, and wherein the arm assembly and the foot-engaging member are together configured to transfer at least an initial vertically downwardly directed force from a person's foot into movement of the step stool member from the stored position toward the deployed position;

whereby the person can move the step stool member from the stored position to the deployed position by engaging the foot-engaging member with only the foot;

wherein the arm assembly comprises at least a first arm member which is pivotally connected to the base member at a first location and to the step stool member at a second location, and wherein when the step stool member is in the stored position, a line extending between the first and second locations is oriented at an angle of less than 90° relative to horizontal as measured from a location in front of the base member;

wherein the step stool assembly further comprises means for generating a force on the step stool member which acts in the direction of movement of the step stool member from the deployed position to the stored position, said force generating means being connected between the first arm member and one of the base member and the step stool member; and wherein the step stool assembly further comprises a latch mechanism which is configured to retain the step stool member in the deployed position when the step stool member is moved from the stored position to the deployed position and then release the step stool member to move back to the stored position after the person steps onto and then off of the step stool member.

7. The step stool assembly of claim 6, wherein the latch mechanism is mounted to one of the side members and, when the step stool member is moved from the stored position to the deployed position, is engageable by a hook member which is connected to a corresponding end portion of the first arm member.

8. The step stool assembly of claim 6, wherein the foot engaging member comprises a foot bar which is connected between the side members.

9. The step stool assembly of claim 6, wherein the base member is configured to be mounted to the floor.

10. The step stool assembly of claim 6, wherein the base member is configured to be mounted to a wall which extends generally vertically from the floor.

11. The step stool assembly of claim 6, wherein the arm assembly comprises at least a second arm member which is pivotally connected between the base member and the step stool member and, when the step stool assembly is viewed in profile with the step stool member in the deployed position, the first arm member is spaced above and oriented generally parallel to the second arm member.

12. The step stool assembly of claim 6, wherein the means for generating a force on the step stool member comprises a gas spring.

13. The step stool assembly of claim 12, wherein the gas spring comprises a first end which is pivotally connected to the base member and a second end which is pivotally connected to the first arm member.

14. A retractable step stool assembly for assisting a person in elevating him or herself above a floor, the step stool assembly comprising:

a base member;

a step stool member which comprises a generally horizontal platform surface and two side members which depend downwardly from opposite ends of the platform surface; and an arm assembly which is configured to pivotally connect the step stool member to the base member for movement of the step stool member between a stored position in which the step stool member is positioned over the base member and a deployed position in which the step stool member is positioned on the floor in front of the base member, the arm assembly being configured such that the platform surface remains generally horizontal during movement of the step stool member between the stored position and the deployed position;

wherein the step stool member comprises a vertically upwardly directed foot-engaging member which is spaced apart from and located vertically below the platform surface, and wherein the arm assembly and the foot-engaging member are together configured to transfer at least an initial vertically downwardly directed force from a person's foot into movement of the step stool member from the stored position toward the deployed position;

whereby the person can move the step stool member from the stored position to the deployed position by engaging the foot-engaging member with only the foot;

wherein the arm assembly comprises at least a first arm member which is pivotally connected to the base member at a first location and to the step stool member at a second location, and wherein when the step stool member is in the stored position, a line extending between the first and second locations is oriented at an angle of less than 90° relative to horizontal as measured from a location in front of the base member; and wherein the first arm member comprises a generally U-shaped configuration having a middle portion which is pivotally connected to the base member and two end portions which are connected to opposite sides of the step stool member.

15. The step stool assembly of claim 14, wherein the foot engaging member comprises a foot bar which is connected between the side members.

16. The step stool assembly of claim 14, wherein the base member is configured to be mounted to the floor.

17. The step stool assembly of claim 14, wherein the base member is configured to be mounted to a wall which extends generally vertically from the floor.

18. The step stool assembly of claim 14, further comprising means for generating a force on the step stool member which acts in the direction of movement of the step stool member from the deployed position to the stored position, said force generating means being connected between the first arm member and one of the base member and the step stool member.

19. The step stool assembly of claim 18, wherein the means for generating a force on the step stool member comprises a gas spring.

20. The step stool assembly of claim 19, wherein the gas spring comprises a first end which is pivotally connected to the base member and a second end which is pivotally connected to the first arm member.

* * * * *